US010217395B2

(12) United States Patent
Ha

(10) Patent No.: US 10,217,395 B2
(45) Date of Patent: Feb. 26, 2019

(54) DISPLAY DEVICE, SOURCE DRIVE INTEGRATED CIRCUIT, TIMING CONTROLLER AND DRIVING METHOD THEREOF

(71) Applicant: LG Display Co., Ltd., Seoul (KR)

(72) Inventor: Sungchul Ha, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 41 days.

(21) Appl. No.: 15/381,440

(22) Filed: Dec. 16, 2016

(65) Prior Publication Data

US 2017/0193892 A1 Jul. 6, 2017

(30) Foreign Application Priority Data

Dec. 31, 2015 (KR) ..... 10-2015-0191810

(51) Int. Cl.
*G09G 3/20* (2006.01)
*G09G 3/3275* (2016.01)
*G09G 3/36* (2006.01)

(52) U.S. Cl.
CPC ..... *G09G 3/2092* (2013.01); *G09G 3/2022* (2013.01); *G09G 3/3275* (2013.01); *G09G 3/3688* (2013.01); *G09G 2310/0275* (2013.01); *G09G 2310/0286* (2013.01); *G09G 2310/0289* (2013.01); *G09G 2310/0294* (2013.01); *G09G 2310/0297* (2013.01); *G09G 2310/08* (2013.01); *G09G 2330/025* (2013.01); *G09G 2330/06* (2013.01); *G09G 2370/08* (2013.01); *G09G 2370/10* (2013.01)

(58) Field of Classification Search
None
See application file for complete search history.

(56) References Cited

U.S. PATENT DOCUMENTS

2009/0058788 A1 3/2009 Ha et al.
2010/0148829 A1 6/2010 Hong et al.
(Continued)

FOREIGN PATENT DOCUMENTS

KR 10-0880222 B1 1/2009
KR 10-2010-0068936 A 6/2010
(Continued)

OTHER PUBLICATIONS

Extended European Search Report dated May 31, 2017, issued in corresponding European Patent Application No. 16207035.3.

*Primary Examiner* — Gustavo D Polo
(74) *Attorney, Agent, or Firm* — Morgan, Lewis & Bockius LLP

(57) ABSTRACT

Provided are a display device and a driving method thereof. Each source drive integrated circuit (IC) of the display device includes a first random signal generator configured to generate a first random signal, a delay unit configured to generate first and second Source Output Enable (SOE) signals by randomly delaying an SOE signal in response to the first random signal, a first output group configured to output a data voltage at a first timing in response to the first internal SOE signal, and a second output group configured to output a data voltage at a second timing in response to the second internal SOE signal. The present disclosure utilizes a random signal generator to randomly disperse timings of SOE signals temporally and spatially within a source drive IC or between source drive ICs, thereby minimizing the peak current.

16 Claims, 17 Drawing Sheets

(56) References Cited

U.S. PATENT DOCUMENTS

| | | | |
|---|---|---|---|
| 2010/0149082 | A1 | 6/2010 | Hong et al. |
| 2010/0156885 | A1 | 6/2010 | Cho et al. |
| 2014/0232713 | A1 | 8/2014 | Hsu et al. |
| 2015/0049076 | A1 | 2/2015 | Kim et al. |
| 2015/0325214 | A1 | 11/2015 | Ryu |

FOREIGN PATENT DOCUMENTS

| | | | |
|---|---|---|---|
| KR | 10-2010-0068938 | A | 6/2010 |
| KR | 10-2010-0073718 | A | 7/2010 |
| KR | 10-2010-0073739 | A | 7/2010 |

| | X1 | X2 | X3 | X4 |
|---|---|---|---|---|
| Seed | 0 | 0 | 0 | 1 |
| Seq. 1 | 1 | 0 | 0 | 0 |
| Seq. 2 | 0 | 1 | 0 | 0 |
| Seq. 3 | 0 | 0 | 1 | 0 |
| Seq. 4 | 1 | 0 | 0 | 1 |
| Seq. 5 | 1 | 1 | 0 | 0 |
| Seq. 6 | 0 | 1 | 1 | 0 |
| Seq. 7 | 1 | 0 | 1 | 1 |
| Seq. 8 | 0 | 1 | 0 | 1 |
| Seq. 9 | 1 | 0 | 1 | 0 |
| Seq. 10 | 1 | 1 | 0 | 1 |
| Seq. 11 | 1 | 1 | 1 | 0 |
| Seq. 12 | 1 | 1 | 1 | 1 |
| Seq. 13 | 0 | 1 | 1 | 1 |
| Seq. 14 | 0 | 0 | 1 | 1 |
| Seq. 15 | 0 | 0 | 0 | 1 |
| Seq. 16 | 1 | 0 | 0 | 0 |
| Seq. 17 | 0 | 1 | 0 | 0 |
| Seq. 18 | 0 | 0 | 1 | 0 |
| Seq. 19 | 1 | 0 | 0 | 1 |
| Seq. 20 | 1 | 1 | 0 | 0 |
| Seq. 21 | 0 | 1 | 1 | 0 |
| Seq. 22 | 1 | 0 | 1 | 1 |

| | X1 | X2 | X3 | X4 | X5 | X6 | X7 | X8 | X9 | X10 | X11 | X12 | X13 | X14 | X15 | X16 |
|---|---|---|---|---|---|---|---|---|---|---|---|---|---|---|---|---|
| Seed | 1 | 0 | 1 | 0 | 0 | 1 | 0 | 0 | 1 | 1 | 1 | 0 | 0 | 0 | 1 | 1 |
| Seq. 1 | 0 | 1 | 0 | 1 | 0 | 0 | 1 | 0 | 0 | 1 | 1 | 1 | 0 | 0 | 0 | 1 |
| Seq. 2 | 0 | 0 | 1 | 0 | 1 | 0 | 0 | 1 | 0 | 0 | 1 | 1 | 1 | 0 | 0 | 0 |
| Seq. 3 | 0 | 0 | 0 | 1 | 0 | 1 | 0 | 0 | 1 | 0 | 0 | 1 | 1 | 1 | 0 | 0 |
| Seq. 4 | 0 | 0 | 0 | 0 | 1 | 0 | 1 | 0 | 0 | 1 | 0 | 0 | 1 | 1 | 1 | 0 |
| Seq. 5 | 0 | 0 | 0 | 0 | 0 | 1 | 0 | 1 | 0 | 0 | 1 | 0 | 0 | 1 | 1 | 1 |
| Seq. 6 | 1 | 0 | 0 | 0 | 0 | 0 | 1 | 0 | 1 | 0 | 0 | 1 | 0 | 0 | 1 | 1 |
| Seq. 7 | 1 | 1 | 0 | 0 | 0 | 0 | 0 | 1 | 0 | 1 | 0 | 0 | 1 | 0 | 0 | 1 |
| Seq. 8 | 0 | 1 | 1 | 0 | 0 | 0 | 0 | 0 | 1 | 0 | 1 | 0 | 0 | 1 | 0 | 0 |
| Seq. 9 | 0 | 0 | 1 | 1 | 0 | 0 | 0 | 0 | 0 | 1 | 0 | 1 | 0 | 0 | 1 | 0 |
| Seq. 10 | 0 | 0 | 0 | 1 | 1 | 0 | 0 | 0 | 0 | 0 | 1 | 0 | 1 | 0 | 0 | 1 |
| Seq. 11 | 1 | 0 | 0 | 0 | 1 | 1 | 0 | 0 | 0 | 0 | 0 | 1 | 0 | 1 | 0 | 0 |
| Seq. 12 | 1 | 1 | 0 | 0 | 0 | 1 | 1 | 0 | 0 | 0 | 0 | 0 | 1 | 0 | 1 | 0 |
| Seq. 13 | 1 | 1 | 1 | 0 | 0 | 0 | 1 | 1 | 0 | 0 | 0 | 0 | 0 | 1 | 0 | 1 |
| Seq. 14 | 0 | 1 | 1 | 1 | 0 | 0 | 0 | 1 | 1 | 0 | 0 | 0 | 0 | 0 | 1 | 0 |
| Seq. 15 | 0 | 0 | 1 | 1 | 1 | 0 | 0 | 0 | 1 | 1 | 0 | 0 | 0 | 0 | 0 | 1 |
| Seq. 16 | 1 | 0 | 0 | 1 | 1 | 1 | 0 | 0 | 0 | 1 | 1 | 0 | 0 | 0 | 0 | 0 |
| Seq. 17 | 1 | 1 | 0 | 0 | 1 | 1 | 1 | 0 | 0 | 0 | 1 | 1 | 0 | 0 | 0 | 0 |
| Seq. 18 | 1 | 1 | 1 | 0 | 0 | 1 | 1 | 1 | 0 | 0 | 0 | 1 | 1 | 0 | 0 | 0 |
| Seq. 19 | 1 | 1 | 1 | 1 | 0 | 0 | 1 | 1 | 1 | 0 | 0 | 0 | 1 | 1 | 0 | 0 |
| Seq. 20 | 0 | 1 | 1 | 1 | 1 | 0 | 0 | 1 | 1 | 1 | 0 | 0 | 0 | 1 | 1 | 0 |
| Seq. 21 | 1 | 0 | 1 | 1 | 1 | 1 | 0 | 0 | 1 | 1 | 1 | 0 | 0 | 0 | 1 | 1 |
| Seq. 22 | 0 | 1 | 0 | 1 | 1 | 1 | 1 | 0 | 0 | 1 | 1 | 1 | 0 | 0 | 0 | 1 |

| | SOE_Start | SOE Width |
|---|---|---|
| SOE1 | 1P*1+R1 | 10*1P |
| SOE2 | 1P*2+R2 | 10*1P |
| SOE3 | 1P*3+R3 | 10*1P |
| ... | ... | ... |
| SOEn-2 | 1P*3+Rn-2 | 10*1P |
| SOEn-1 | 1P*2+Rn-1 | 10*1P |
| SOEn | 1P*1+Rn | 10*1P |

DISPLAY DEVICE, SOURCE DRIVE INTEGRATED CIRCUIT, TIMING CONTROLLER AND DRIVING METHOD THEREOF

This application claims the benefit of Korean Patent Application No. 10-2015-0191810 filed on Dec. 31, 2015, the entire contents of which is incorporated herein by reference for all purposes as if fully set forth herein.

BACKGROUND

Field of the Invention

The present disclosure relates to a display device and a driving method thereof.

Discussion of the Related Art

There are various flat display devices including a Liquid Crystal Display (LCD) device and an Organic Light Emitting Diode (OLED) device. The LCD displays an image by controlling an electric field, applied to liquid molecules, according to a data voltage. In an active-matrix display device, each pixel includes a Thin Film Transistor (TFT) formed therein.

An active-matrix OLED device utilizes an Organic Light Emitting Diode (OLED) and thus exhibits fast response speed, great luminance, and a wide viewing angle. Each OLED includes an organic compound layer formed between an anode and a cathode. The organic compound layer consists of a Hole Injection layer (HIL), a Hole transport layer (HTL), an Emission layer (EML), an Electron transport layer (ETL), and an Electron Injection layer (EIL). Once a driving voltage is applied to the anode and the cathode, a hole passing through the HTL and an electron passing through the ETL move to the EML, and therefore, the EML generates a visible light accordingly.

Such a display device includes a plurality of source drive integrated circuits (ICs) for supplying a data voltage to data lines, a plurality of gate drive ICs for sequentially supply a gate pulse (or a scan pulse) to gate lines (or scan lines) of the display panel, and a timing controller for controlling the drive ICs.

Through an interface, such as a mini Low Voltage Differential Signaling (LVDS) interface, the timing controller supplies the source drive ICs with digital video data, a clock for sampling the digital video data, and a control signal for controlling operation of the source drive ICs. The source drive ICs convert digital video data, received from the timing controller, into an analog data voltage, and supply the analog data voltage to the data lines.

In a case the timing controller and the source drive ICs are connected in a multi-drop fashion via the mini LVDS interface, various and many lines are required: for example, an R data transmission line, a G data transmission line, a B data transmission line, and control lines for controlling the source drive ICs are necessary between the controller and the source drive ICs. In the case of transmission of RGB data via the mini LVDS interface, RGB digital video data and a clock are separately transmitted with a differential signal pair. In this case, for simultaneous transmission of odd-numbered data and even-numbered data, at least fourteen lines between the timing controller and the source drive ICs are required in order to transmit RGB data. If RGB data is 10 bits, eighteen lines are needed. Therefore, a lot of lines have to be formed on a source Printed Circuit Board (PCB) mounted between the timing controller and the source drive ICs, and thus, it is such a challenge to reduce the width of the source PCB.

The applicant of this application has proposed a new signal transmission protocol (hereinafter, referred to as "Embedded Panel Interface (EPI) protocol") in Korean Patent Application No. 10-2008-0127458 (Dec. 15, 2008), U.S. patent Ser. No. 12/543,996 (Aug. 19, 2009), Korean Patent Application No. 10-2008-0127456 (Dec. 15, 2008), U.S. patent application Ser. No. 12/461,652 (Aug. 19, 2009), Korean Patent Application No. 10-2008-0132466 (Dec. 23, 2008), and U.S. patent application Ser. No. 12/537,341 (Aug. 7, 2009). The EPI protocol is for connecting a timing controller and source drive ICs in a point-to-point manner so as to minimize the number of lines necessary between the timing controller and the source drive ICs and stabilize signal transmission.

The EPI protocol satisfies interface requirements (1) to (3) as below.

(1) A transmitting end of the timing controller and receiving ends of the source drive ICs do not share a line and instead bypasses a data line pair which connects the transmitting end of the timing controller and the receiving ends of the source drive ICs in a point-to-point manner.

(2) The timing controller and the source drive ICs are not connected using an additional clock line pair. The timing controller transmits a clock signal, video data, and control data to the source drive ICs through the data line pair.

(3) A clock recovery circuit for Clock and Data Recovery (CDR) is embedded in each of the source drive ICs. In order to lock an output phase and a frequency of the clock recovery circuit, the timing controller transmits a clock training pattern signal (or a preamble) to a source to the source drive ICs. When the clock training pattern signal and a clock signal are input through a data line pair, clock recovery circuit embedded in each of the source drive ICs recovers the clock signal to generate an internal clock.

If the phase and frequency of the internal clock are locked, the source drive ICs inputs, to the timing controller, a lock signal LOCK at a high logic level which indicates a state of output stability. The lock signal LOCK is input to the timing controller along a lock feedback line that connects the timing controller and the last source drive IC.

According to the EPI protocol, as described above, the timing controller transmits a clock training pattern signal to the source drive ICs before transmitting control data and video data of an input image. A clock recovery circuit embedded in each of the source drive IC performs a clock training operation by outputs an internal clock with reference to the clock training pattern signal and then recovering a clock. If the phase and frequency of the internal clock is stably fixed, the clock recovery circuit establishes a data link with the timing controller. In response to a lock signal received from the last source drive IC, the controller starts to transmit the control data and the video data to the source drive ICs.

An LCD device processes a great volume of data at a high speed and data traffic load increases because a display panel has high resolution and a large screen. If the source drive ICs outputs data voltages at the same time when the data traffic load has increased, it may result in an increase in noise of electromagnetic interference (EMI) in a broadband. To reduce the EMI, an SOE Split scheme may be applied which is used to separate timings of Source Output Enable (SOE) signals. In the SOE Split scheme, output timings of the source drive ICs are disperse along the time axis to reduce the peak current of the source drive ICs. The SOE Split scheme renders delay time of each SOE signal different, the SOE signal which is for controlling an output timing of a source drive IC. The SOE Split scheme is disclosed in Korean Patent Application No. 10-2010-0073739 (Jul. 1, 2010), and Korean Patent No. 10-0880222 (Jan. 16, 2009), both of which are invented by the applicant of this application.

The conventional SOE Split scheme has to adjust a timing of an SOE signal at a predetermined tine interval. As the conventional SOE Split scheme splits a timing of the SOE signal at the predetermined time interval, the effects in reducing the peak current are limited. In addition, as the conventional SOE Split scheme splits a timing of the SOE signal at the predetermined time interval, the timing of SOE signals in a source drive IC or between source drive ICs may periodically overlap. As the conventional SOE Split scheme causes the timing of SOE signals in a source drive IC or between source drive ICs to overlap, there is an accumulated value of the peak current. The accumulated value of the peak current is hard to anticipate because propagation delay differs according to size and resolution of a display panel. Even when the same IC chip is used, a different level of EMI is found in each display panel model. Therefore, the conventional SOE Split Scheme has a limitation in reducing the EMI.

SUMMARY

Accordingly, the present invention is directed to a display device and a driving method thereof that substantially obviates one or more of the problems due to limitations and disadvantages of the related art.

The object of the present disclosure is to provide a display device enabled to minimize electromagnetic interface (EMI) of source drive integrated circuits (ICs), and a driving method of the display device.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a display device comprises a display panel in which data lines and gate lines are intersecting each other and pixels are arranged in a matrix; first and second source drive integrated circuits (ICs) configured to supply a data voltage to the data lines of the display panel in response to a Source Output Enable (SOE) signal; and a timing controller configured to transmit data of an input image and the SOE signal to the source drive ICs.

Each of the source drive ICs may include: a first random signal generator configured to generate a first random signal; a delay unit configured to randomly delay the SOE signal in response to the first random signal to generate first and second internal SOE signals; a first output group configured to output the data voltage at a first timing in response to the first internal SOE signal; and a second output group configured to output the data voltage at a second timing in response to the second internal SOE signal.

The timing controller may include: a random signal generator configured to generate a second random signal; and a signal generator configured to, in response to the second random signal, randomly delay a reference source output signal to generate a first SOE signal for controlling an output timing of the first source drive IC and a second SOE signal for controlling an output timing of the second source drive IC.

At least one of the first and second random signal generators may include a Linear Feedback Shift Register (LFSR).

At least one of the delay unit and the signal generator may include: a multiplexer configured to, in response to an output signal of the LFSR, select any one of clocks whose phases are sequentially delayed; and a flipflop configured to, in response to a clock received from the multiplexer, output latched input data to output the first and second internal SOE signals.

The display device may further include a switch array disposed between the random signal generator and the multiplexer. The switch array may periodically or randomly change a signal transmission path between the first random signal generator and the multiplexer.

In another aspect, a source drive IC of a display device comprises a random signal generator configured to generate a random signal; a delay unit configured to randomly delay a Source Output Enable (SOE) signal in response to the random signal to generate first and second internal SOE signals; a first output group configured to output a data voltage at a first timing in response to the first internal SOE signal; and a second output group configured to output a data voltage at a second timing in response to the second internal SOE signal.

In another aspect, a timing controller of a display device comprises a random signal generator configured to generate a random signal; and a signal generator configured to, in response to the random signal, randomly delay a reference source output signal to generate a first Source Output Enable (SOE) signal for controlling an output timing of a first source drive integrated circuit (IC) and a second SOE signal for controlling an output timing of a second source drive IC.

In another aspect, a driving method of a display device comprises generating a first random signal; in response to the first random signal, randomly delaying a Source Output Enable (SOE) signal to generate first and second internal SOE signals; and controlling an output timing of a first output group within a first source drive Integrated Circuit (IC) in response to the first internal SOE signal, and controlling an output timing of a second output group within the first source drive IC in response to the second internal SOE signal.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Hereinafter, embodiments of the present disclosure are described in detail with reference to the accompanying drawings. Also, descriptions of well-known functions and constructions may be omitted for increased clarity and conciseness.

A display device according to the present disclosure may be implemented by a display device including source drive integrated circuits (ICs). Such a display device may be, for example, a flat display device such as a Liquid Crystal Display (LCD) and an Organic Light Emitting Diode (OLED) display device.

Figure 1:
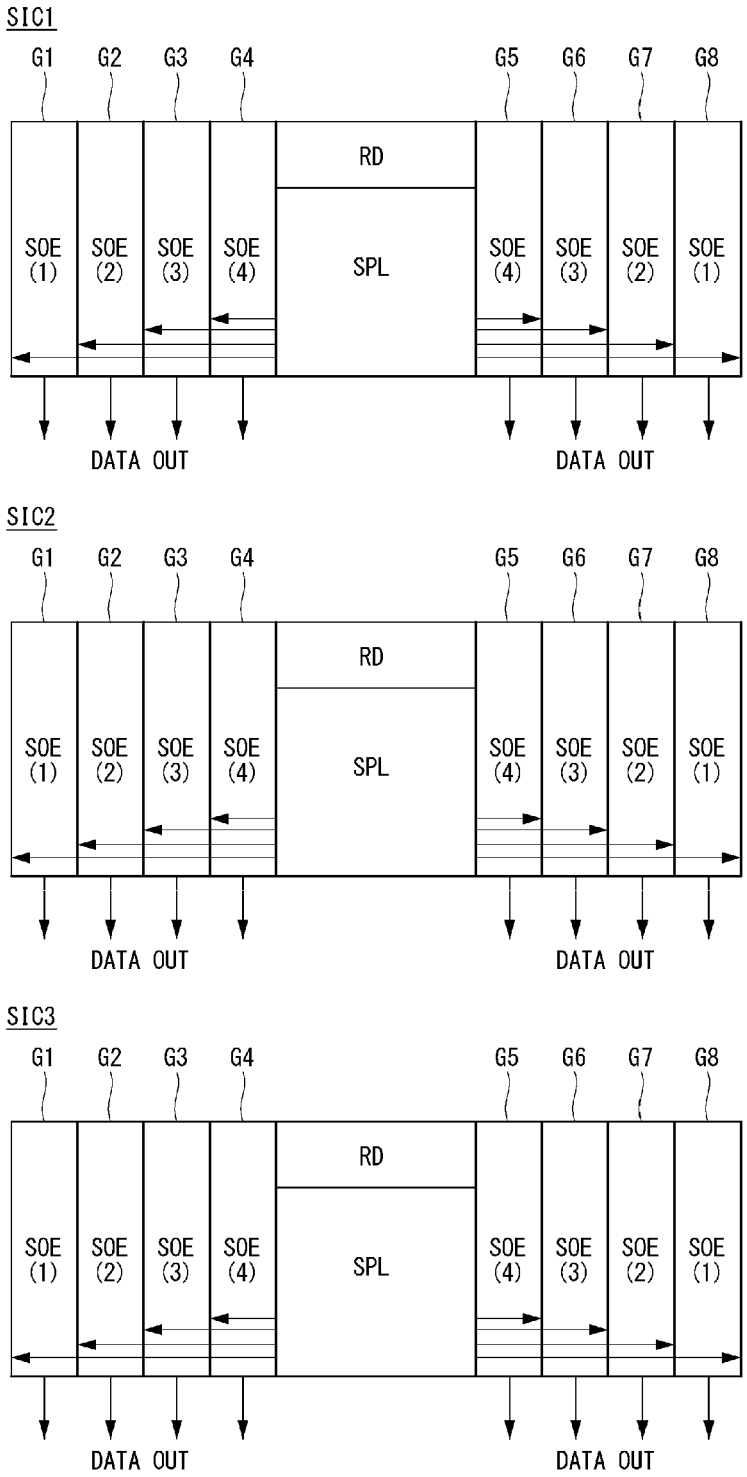
FIG. 1 is a diagram illustrating output groups whose output timings are dispersed in a source drive integrated circuit (IC) in accordance with a Source Output Enable (SOE) signal according to an embodiment of the present disclosure.
Figure 2:
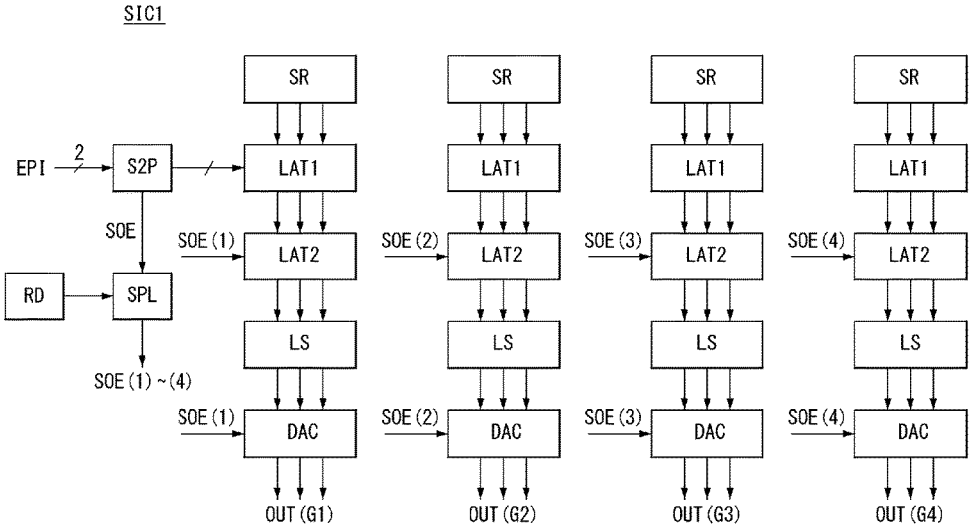
FIG. 2 is a diagram illustrating details of the source drive IC shown in FIG. 1.

Referring to FIGS. 1 and 2, each source drive IC among SIC1 to SIC3 according to the present disclosure includes a serial-to-parallel converter S2P, a random signal generator RD, a Source Output Enable signal (SOE) delay unit SPL, and a plurality of output groups G1 to G8.

Each of the source drive ICs SIC1 to SIC3 recovers an SOE signal based on input data received from a timing controller TCON, randomly delay the SOE signal in accordance with an output signal from the random signal generator RD, and disperses the delayed SOE signal to the output groups. The timing controller TCON may transmit a clock, data of an input image, and control data to the source drive ICs SIC1 to SIC3 via an Embedded Panel Interface (EPI), but aspects of the present disclosure are not limited thereto.

Figure 14:
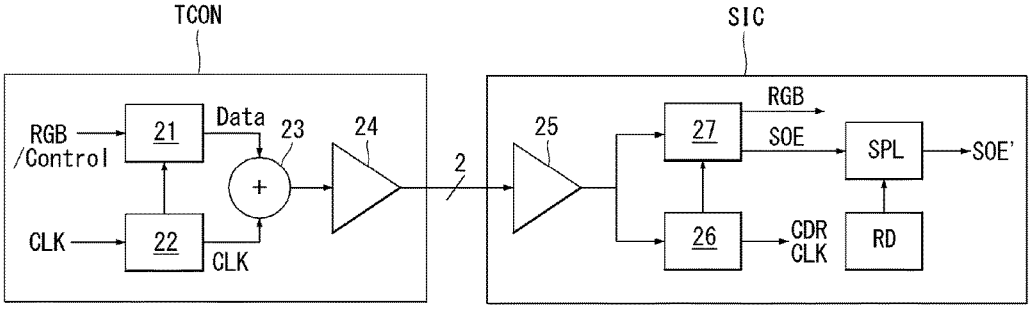
FIG. 14 is a diagram illustrating a timing controller and a Clock and Data Recovery (CDR) circuit of a source drive IC, which are shown in FIG. 13.

The serial-to-parallel converter S2P includes a CDR circuit 26 and a sampling circuit 27, which are illustrated in FIG. 14. The CDR circuit 26 inputs received clock bits into a clock recovery circuit to recover internal clocks which are to be toggled to the clock bits. The clock recovery circuit outputs the internal clocks using a Phase Locked Loop (PLL) or a Delay Locked Loop (DLL). The serial-to-parallel converter S2P samples video data bits of an input image in accordance with the timing of the internal clocks, and outputs sampled RGB bits into parallel data. In addition, the serial-to-parallel converter S2P samples control data bits in accordance with the timing of the internal clocks, and recovers an SOE from the control data.

The random signal generator RD generates a random signal that changes irregularly. The random signal generator RD may use a random generation circuit such as a well-know a random number generator. In addition, the random signal generator RD may be implemented using a Linear Feedback Shift Register (LFSR).

The SOE delay unit SPL delays an SOE signal in response to a random signal from the random signal generator RD so as to randomly adjust delay timings of signals SOE(1) to SOE(4) which are used to delay output timings of the output groups G1 to G8. The signals SOE(1) to SOE(4) output from the SOE delay unit SPL are dispersed over the output groups. For example, the signal SOE(1) is supplied to a first output group G1, the signal SOE(2) is supplied to a second output group G2, the signal SOE(3) is supplied to a third output group G3, and the signal SOE (4) is supplied to a fourth output group G4.

The output groups G1 to G8 respectively output a data voltage in response to the signals SOE(1) to SOE(4) from the SOE delay unit SPL. Since the signals SOE(1) to SOE(4) are randomly delayed, the output timings of data voltages output from the output groups G1 to G8 are irregularly dispersed along the time axis.

Each of the output groups G1 to G8 includes a shift register SR, a first latch array LAT1, a second latch array LAT2, a level shifter LS, and a digital-to-analog converter DAC. The shift register SR shifts a recovered clock. The shift register SR transmits a carry signal to a shift register SR of a next output group when data exceeding the latch number of the first latch array LAT1 is supplied. The first latch array LAT1 samples and latches digital video data of an input image in response to internal clock signals sequentially received from the shift register SR, and then outputs the resulting data at the same time. The second latch array LAT2 latches data received from the first latch array LAT1, synchronizes the latched data with the rising edges of SOE(1) to SOE(4), and outputs the resulting data. The second latch arrays LAT2 of the output groups G1 to G8 output latched data at the same time in response to the signals SOE(1) to SOE(4).

The level shifter LS shifts a voltage level of data received from the second latch array LAT2 to fall within a voltage range of the digital-to-analog converter DAC. The digital-to-analog converter DAC generates a data voltage by converting data received through the level shifter LS into a gamma compensation voltage. The data voltage output from the digital-to-analog converter DAC is supplied to data lines of the display panel through an output buffer which is not shown in the drawings. In FIG. 2, OUT(G1), OUT(G2), OUT(G3), and OUT(G4) are respective outputs from the output groups G1 to G4.

Figure 3:
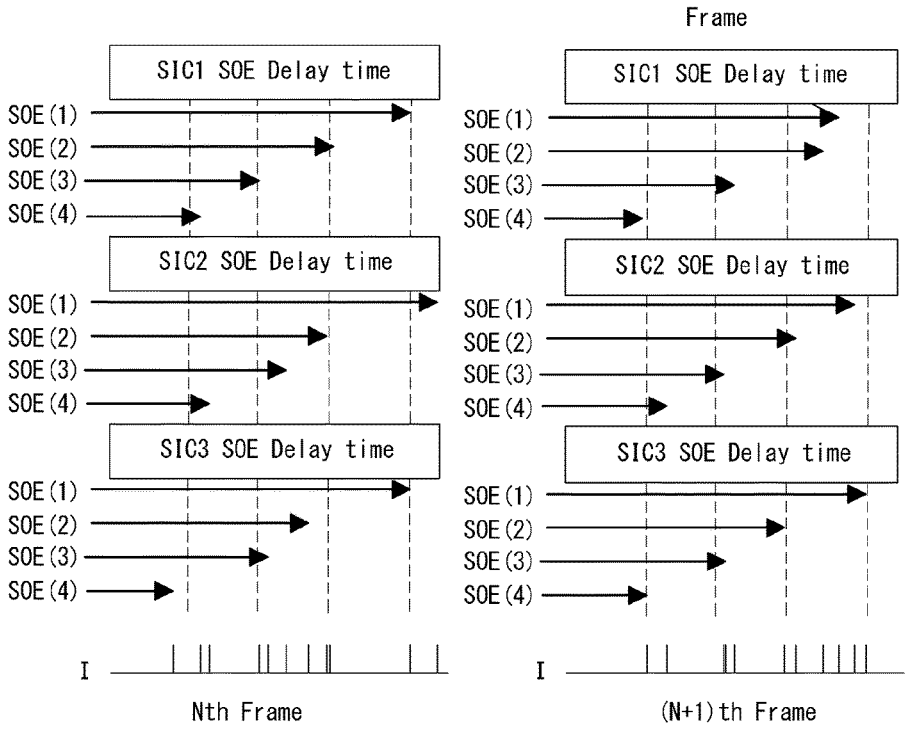
FIG. 3 is a diagram illustrating a peak current which is dispersed over output groups of the source drive IC shown in FIG. 1.

Because the signals SOE(1) to SOE(4) are dispersed over the output groups and randomly delayed, the output timings of the latch arrays LATs and the digital-to-analog converters DAC of the output groups are irregularly dispersed temporally and spatially. Thus, in the present disclosure, as illustrated in FIG. 3, output timings of data voltages from output channels within a source drive IC may be disperse to thereby reduce a peak current (IC) and therefore reduce the EMI. In addition, output timings of the latch arrays LATs and the digital-to-analog converters are dispersed for groups partitioned within the source drive IC to thereby reduce the peak current (IC) of the latch array LAT2 and the digital-to-analog converters DAC and therefore reduce the EMI. The delayed time of each of the signals SOE(1) to SOE(4) is randomly changed within one frame period in source drive ICs and in output groups of a source drive IC. The delay time of each of the signals SOE(1) to SOE(4) is changed in each frame period (e.g., Nth Frame and (N+1)th Frame) in the same source drive IC and in the same output group. Thus, data output timing is randomly changed temporally and spatially between source drive ICs and between output groups, thereby minimizing the peak current (I). If the source drive ICs SIC1 to SIC3 outputs a data voltage from a falling edge of an SOE signal, the signals SOE(1) to SOE(4) falls at the end of the arrow in FIG. 3.

Figure 4:
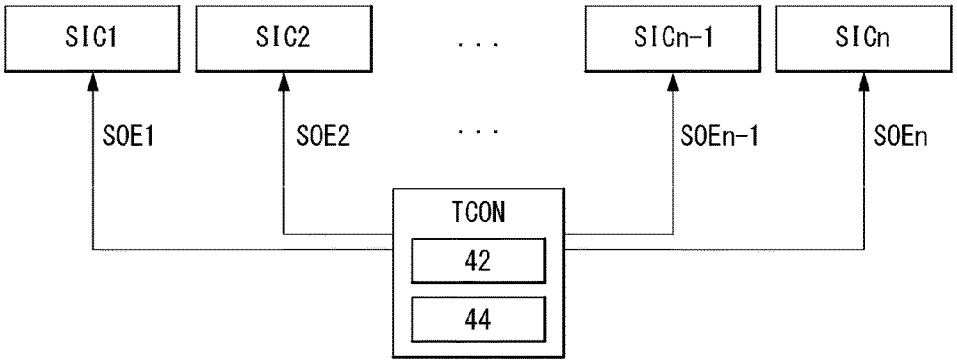
FIG. 4 is a diagram illustrating SOE signals which are respectively input to source drive ICs.
Figure 5:
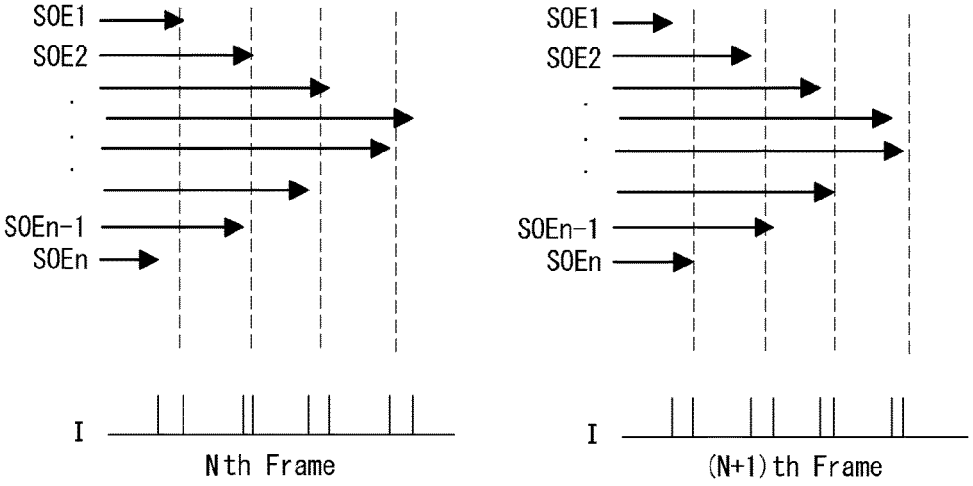
FIG. 5 is a waveform view illustrating the SOE signals shown in FIG. 4.

FIG. 4 is a diagram illustrating SOE signals SOE1 to SOEn respectively input to source drive ICs SIC1 to SICn. FIG. 5 is a waveform view illustrating the SOE signals SOE1 to SOEn shown in FIG. 4.

Referring to FIGS. 4 and 5, the timing controller TCON supplies the source drive ICs SIC1 to SICn with SOE signals SOE1 to SOEn, respectively, and the SOE signals SOE1 to SOEn are randomly delayed.

The first source drive IC SIC1 outputs a data voltage in response to a first SOE signal SOE1 received from the timing controller TCON. The second source drive IC SIC2 outputs a data voltage in response to a second SOE signal SOE2 received from the timing controller TCON. The n-th source drive IC SICn outputs a data voltage in response to a n-th SOE signal SOEn received from the timing controller TCON (n is an integer equal to or greater than 2).

The timing controller TCON includes a random signal generator 42 and an SOE generator 44. The random signal generator 42 generates a second random signal. The SOE generator 44 generates a plurality of SOE signals SOE1 to SOEn. Each of the SOE signals SOE1 to SOEn randomly delays a reference SOE signal in response to a second random signal, so that the output timings of the plurality of source drive ICs may be controlled differently. Using the random signal generator 42, the timing controller TCON randomly adjusts delay time of the SOE signals SOE1 to SOEn to further disperse the peak current between the source drive ICs SIC1 to SICn temporally and spatially and therefore further reducing the EMI. The delay time of each of the SOE1 to SOEn is randomly changed within one frame. In addition, the delay time of the SOE signals SOE1 to SOEn is changed in each frame period (e.g., Nth Frame and (N+1)th Frame) in the same source drive IC and in the same output group.

Figure 6:
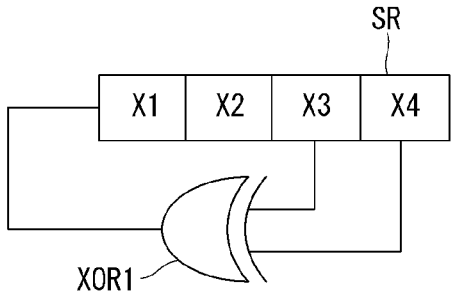
FIGS. 6 and 7 are diagrams illustrating examples of a random signal generator.
Figure 7:
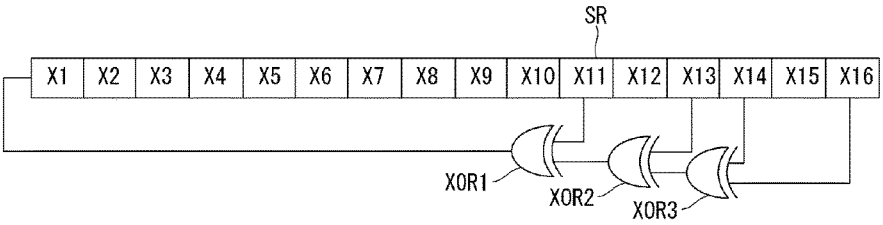

FIGS. 6 and 7 are diagrams illustrating an example of a random signal generator RD.

Referring to FIGS. 6 and 7, the random signal generator RD may include an LFSR. The LFSR generates an output based on a linear function using XOR. An initial bit value (seed) of the LFSR is input when the LFSR is reset.

The LFSR according to the present disclosure includes a shift register SR composed of dependently connected latches, and one or more XOR gates XOR1, XOR2, and XOR3 connected between some latches and the front end. The tables provided in FIGS. 6 and 7 are truth tables of the LFSR.

The XOR gates XOR1, XOR2, and XOR3 performs XOR operation on output data of some latches, and input the feedback into the front-end latch X1 to enable the shift register SR to receive a new input at each clock. The LFSR receives a new input at every sequence as a feedback that is input through the XOR gates XOR1, XOR2, and XOR3. Here, a sequence may be one horizontal period 1H. One horizontal period 1H is the same as one period of a data enable signal DE or a horizontal synchronization signal Hsync, and the same as one scan period in which data is written into pixels of a line on a display panel. When the LFSr is reset, the initial bit value (seed) is changed and thus the sequence is changed.

In the LFSR, the number of XOR gates and a relationship between the XOR gates and the shift register SR are different between the source drive ICs SIC1 to SICn and between output groups of a source drive IC. In addition, the initial bit value (seed) simultaneously input to LFSRs may be set differently between the source drive ICs SIC1 to SICn and between output groups of a source drive IC.

Even the random signal generator RD within the timing controller TCON may use an LFSR or a well-known random number generator.

Figure 8:
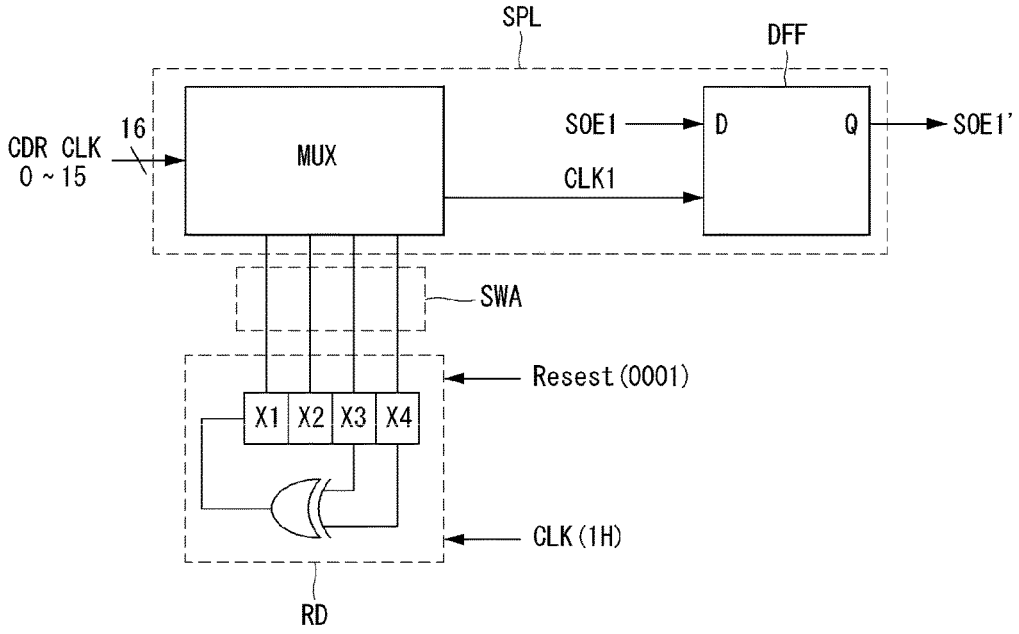
FIGS. 8 and 9 are diagrams illustrating details of a random signal generator and an SOE delay unit.
Figure 9:
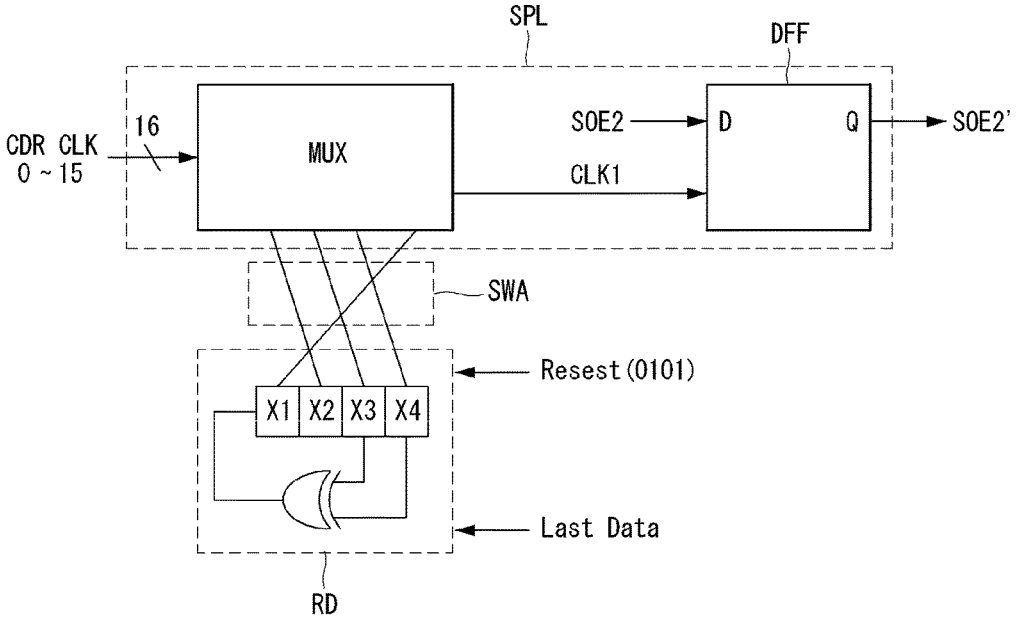

FIGS. 8 and 9 are diagrams illustrating details of a random signal generator RD and an SOE delay unit SPL.

Referring to FIGS. 8 and 9, as described above, whenever being reset, an LFSR of the random signal generator RD receives a new initial bit value (seed) and then outputs a new output in each sequence. The LFSR moves to a next sequence in accordance with a clock CLK(1H) which occurs every one horizontal period.

Figure 18:
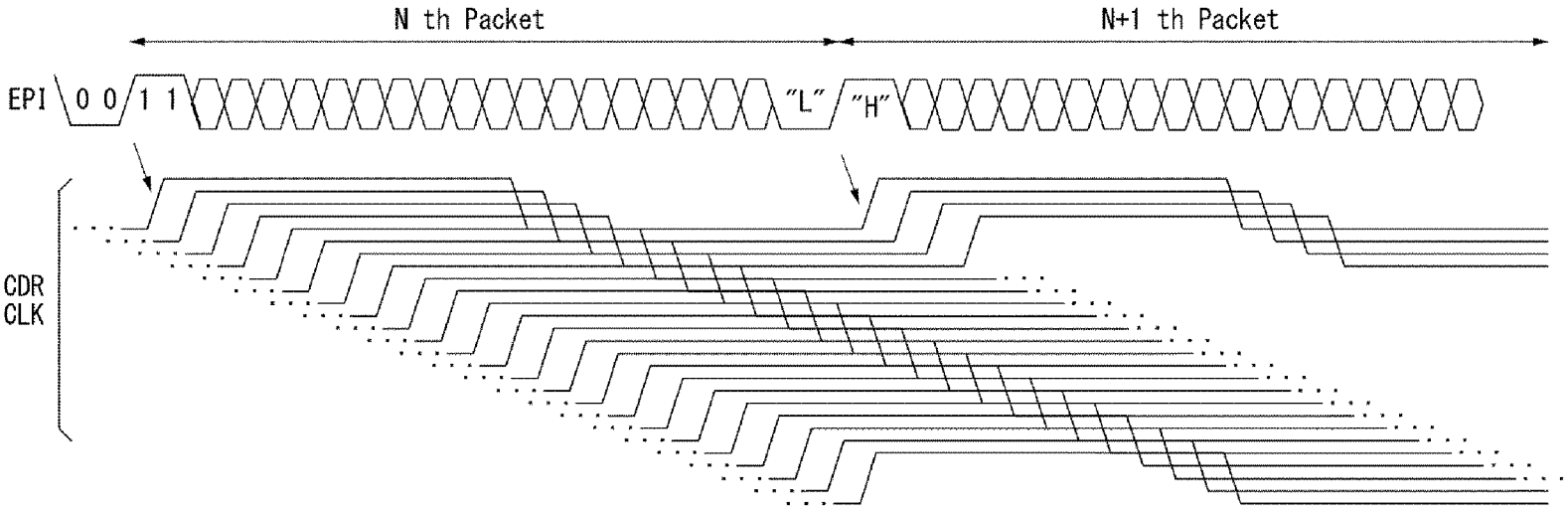
FIG. 18 is a waveform view illustrating an internal clock recovered by a CDR circuit.

The SOE delay unit SPL includes a multiplexer MUX and a flipflot DFF. The multiplexer MUX receives clocks CDR CLK0 to 15, phases of which are delayed sequentially, and selects any one from among the 16 clocks CDR CLK 0 to 15 in accordance with an output of the random signal generator RD. The clocks CDR CDL0 to 15 may be internal clocks (see FIG. 18) which are recovered by CDR circuits in the source drive ICs SIC1 to SICn, but aspects of the present disclosure are not limited thereto. The number of output bits of the random signal generator RD and the number of clocks CDR CLK0 to 15 are not limited to the examples shown in FIGS. 8 and 9. The SOE generator of the timing controller TCON may have configuration similar to that of the SOE delay unit SPL.

The output clock timing of the multiplexer MUs is randomly changed according to an output from the random signal generator RD. The flipflop DFF receives an SOE signal and latches the received SOE signal. Then, when a clock CLK1 from the multiplexer MUX is received, the flipfllp DFF outputs the latched data to output delayed SOE signals SOE1' and SOE2'. Because the clock CLK1 input to the flipflop DFF is randomly selected according to an output from the random signal generator RD, the delay time of an SOE signal is randomly changed.

To further increase randomness of an SOE signal, a switch array SWA may be disposed between the random generator RD and the multiplexer MUX. The switch array SWA may periodically or randomly change a signal transmission path between the random signal generator RD and the multiplexer MUX. In addition, whenever the LFSR is initialized, an initial bit value (seed) is changed to increase randomness of an SOE signal.

Figure 10:
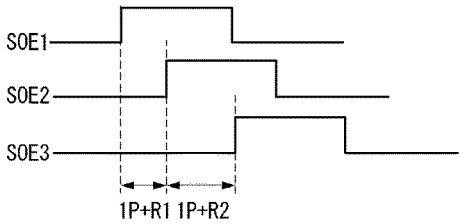
FIG. 10 is a diagram illustrating an example in which control data transmitted to an Embedded Panel Interface (EPI) is used to control start timings of SOE signals differently.

If an EPI is used as an interface, it is possible to adjust a delay time of an SOE signal independently of the source drive ICs SIC1 to SICn, by using control data that is transmitted by the timing controller TCON to each of the source drive ICs SIC1 to SICn. The timing controller TCON may set SOE start information and SOE width information differently for each source drive IC, and randomly change those information in response to an output signal from the random signal generator RD. Thus, using the EPI and the random signal generator RD, the present disclosure may differently control start timings of SOE signals SOE1 to SOEn that are respectively supplied to the source drive ICs SIC1 to SICn, as shown in FIG. 10. In FIG. 10, 1P indicates the length of one data packet. Each of R1, R2, . . . Rn indicates delay time that is randomly determined according to an output of the random signal generator RD. In FIG. 10, an SOE pulse width is fixed, but the present disclosure may finely adjusts not just start timings of the SOE signals SOE1 to SOEn, but pulse width of the SOE signals thereby further reducing the peak current and the EMI.

Figure 11:
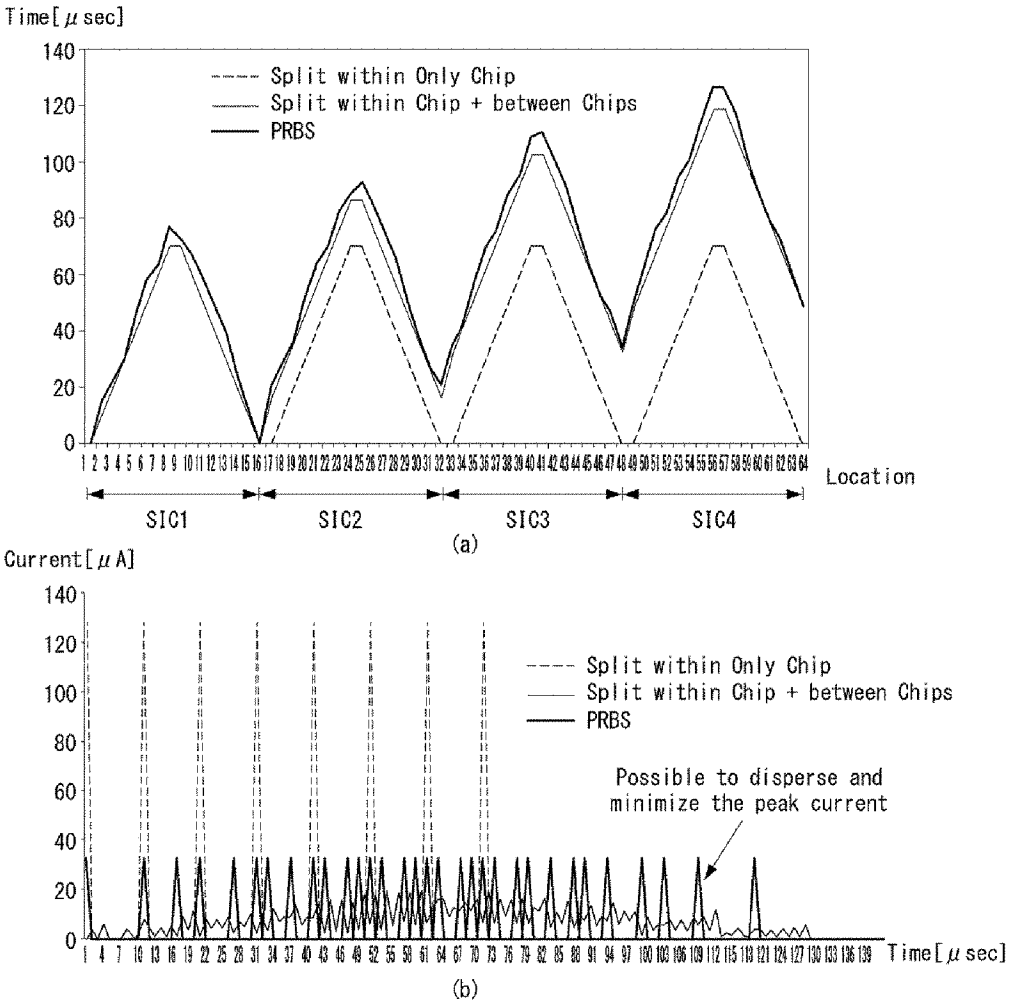
FIGS. 11 and 12 are diagrams illustrating simulation result in which the present disclosure is compared with comparable examples.
Figure 12:
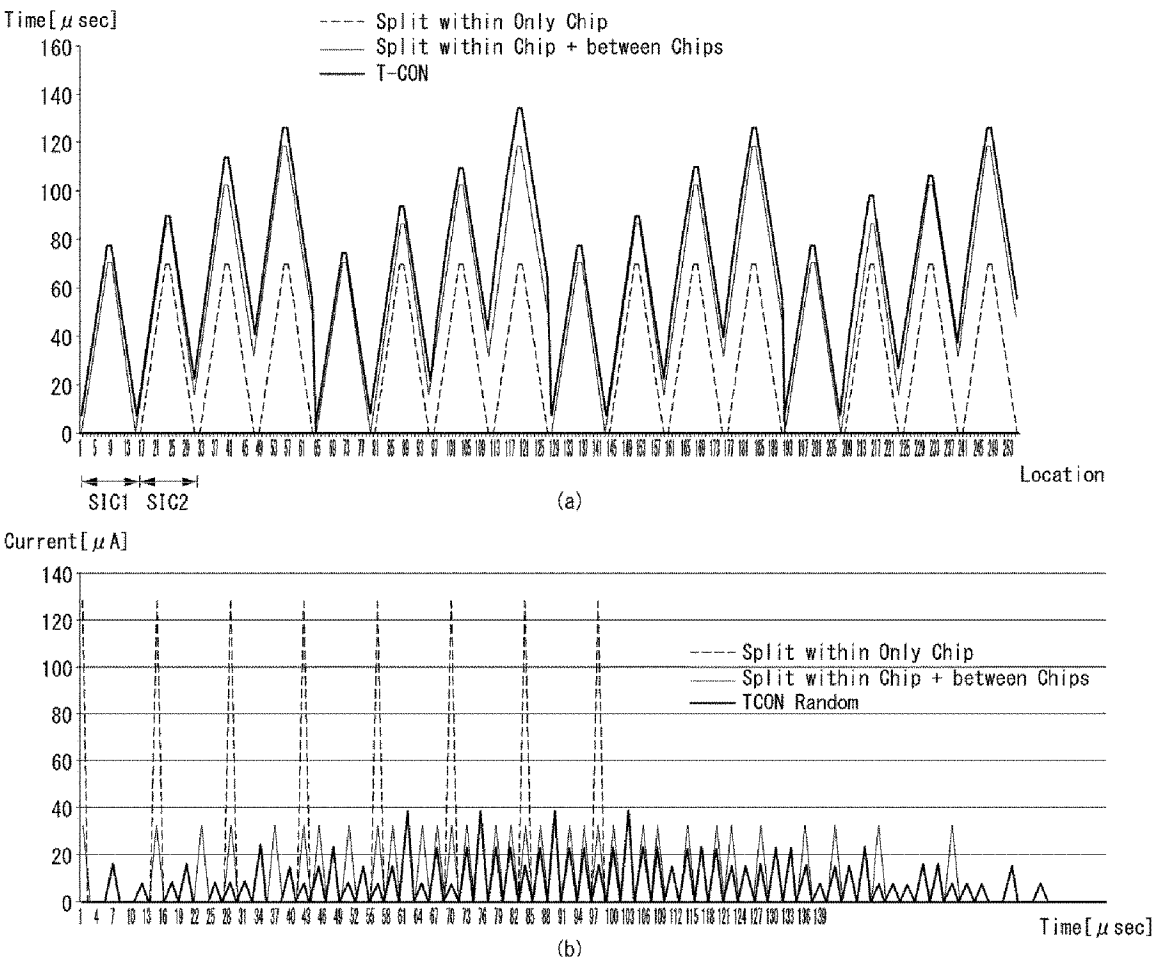

FIGS. 11 and 12 are diagrams illustrating simulation results, each diagram in which the present invention and a comparable example are compared to show the effects of the present disclosure.

In graph (a) of FIGS. 11 and 12, the X axis represents physical locations of source drive ICs and the Y axis represents a time axis. Graph (a) shows delay timings of an SOE signal. In graph (a), a distance between two base vertices of a triangle is a distance of a source drive IC. "Split within Only Chip" is Comparative Example 1 in which SOE signals are dispersed over channel groups within a source drive IC by employing the conventional SOE split method. "Spilt within a chip+between chips" is Comparative Example 2 in which SOE signals are dispersed over channel groups in a source drive IC and into source drive ICs by employing the conventional SOE split method. "PRBS (pseudo-random binary sequence)" and "TCON Random" are examples of the present disclosure in which SOE signals are delayed for output groups in a source drive IC and for source drive ICs by using a random signal generator RD which utilizes an LFSR. In graph (b), the X axis is a time axis, and the Y axis represents currents (I). As shown in FIGS. 11 and 12, the present disclosure make it possible to dramatically reduce the peak current (I) compared to Comparative Examples 1 and 2, and therefore the EMI may be further reduced.

Figure 13:
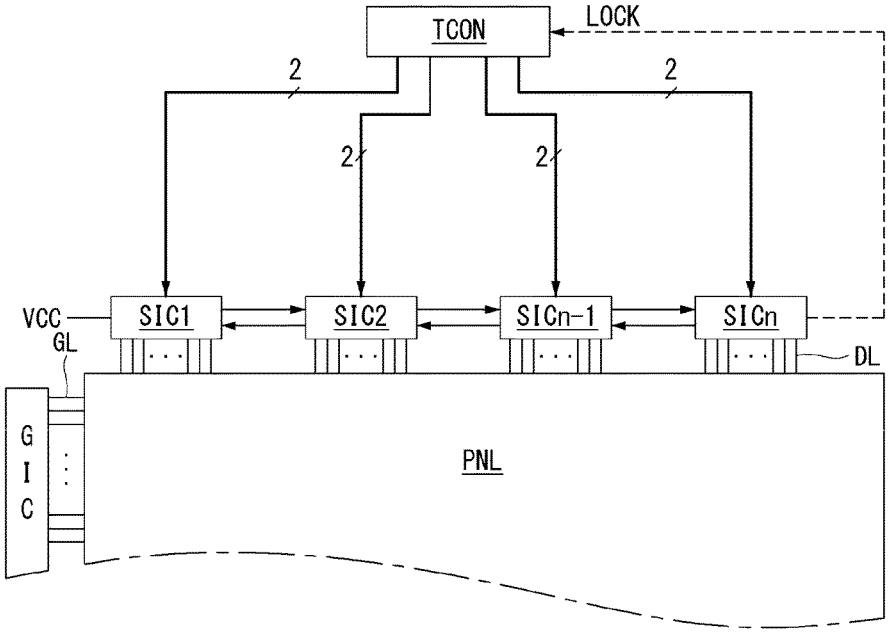
FIG. 13 is a diagram illustrating a display device according to an embodiment of the present disclosure.

FIG. 13 is a diagram illustrating a display device according to an embodiment of the present disclosure.

Referring to FIG. 13, a liquid crystal device (LCD) according to an embodiment of the present disclosure includes a display panel PNL, a timing controller TCON, one or more source drive ICs SIC1 to SICn, and gate drive ICs GIC.

The display panel PNL includes pixels that are arranged in a matrix due the intersecting structure of data lines and gate lines. The source drive ICs SIC1 to SICn are connected to the data lines to supply a data voltage to the data lines In FIG. 13, a solid line is a data line pair along which signals, such as a clock training pattern signal, control data, and video data of an input image, are transmitted on an EPI protocol. In FIG. 13, a dotted line is a lock feedback line that connects the last source drive IC SICn and the timing controller TCON.

The timing controller TCON receives an external timing signal from a not-shown external host system via an interface such as a Low Voltage Differential Signaling (LVDS) interface and a Transition Minimized Differential Signaling (TMDS) interface. The external timing signal includes a vertical synchronization signal Vsync, a horizontal synchronization signal Hsync, an external data enable signal DE, and a main clock. The timing controller TCON is connected in serial to each of the source drive ICs SIC1 to SICn along a data line pair. While satisfying the aforementioned EIP protocol, the timing controller TCON transmits digital video data of an input image to the source drive ICs SIC1 to SICn in order to control operation timings of the source drive ICs SIC1 to SICn and the gate drive IC GIC. The timing controller TCON converts a clock training pattern signal, control data, digital video data of an input image, etc. into pairs of differential signals, and transmits the pairs of differential signals, in a serial fashion, to the source drive ICs SIC1 to SICn according to the signal transmission standard set by the EIP protocol. Signals transmitted from the timing controller TCON to the source drive ICs SIC1 to SICn include an EPI clock CLK.

When a lock signal LOCK input through the lock feedback line is at a logic low level, the timing controller TCON transmits a clock training pattern signal to the source drive ICs SIC1 to SICn. When the lock signal LOCK is reversed to a high logic level, the timing controller TCON resumes transmitting control data and digital video data of an input image. The lock signal LOCK which is feedback to the timing controller TCON is reversed to the low logic level only when outputting from clock recovery circuits of all the source drive ICs SIC1 to SICn is unlocked.

When the source drive ICs SIC1 to SICn receives a lock signal LOCK at the high logic level and a clock training pattern signal from source drive ICs at the previous stage, the phase and the frequency of a signal from a CDR circuit is locked through clock training, and therefore, the CDR function becomes stabilized. Then, the source drive ICs SIC1 to SICn transmits the lock signal LOCK at the high logic level to source drive ICs at the next stage. When the CDR function of each of the source drive ICs SIC1 to SICn becomes stabilized, the last source drive IC SIC6 transmits a lock signal LOCK at the high logic level to the timing controller along the lock feedback line. A lock signal input terminal of the first source drive IC SIC1 is not connected to a lock signal output terminal of a source drive IC at the previous stage. An direct current (DC) power voltage VCC at a high logic level is input to the lock signal input terminal of the first source drive IC SIC1.

Each of the source drive ICs SIC1 to SICn may be connected to the data lines of the display panel PNL through a Chip On Glass (COG) process or a Tape Automated Bonding (TAB) process. Along a data line pair, the source drive ICs SIC1 to SICn receives a clock training pattern signal, control data, and video data, each of which contains an EPI clock. Each CDR circuit of the source drive ICs SIC1 to SICn recovers an internal clock of an EIP clock received from the timing controller TCON.

The source drive ICs SIC1 to SICn sample video data bits of an input image in accordance with an internal clock timing, and convert sampled RGB bits into parallel data.

The source drive ICs SIC1 to SICn recover source control data and gate control data by decoding control data, received along a data line pair, in a code mapping method. In response to the recovered source control data, the source drive ICs convert video data of an input image into a data voltage and supply the data voltage to the data lines DL of the display panel PNL. The source drive ICs SIC1 to SICn may transmit the gate control data to at least one of the gate drive ICs GIC.

The gate drive ICs GIC may be connected to gate lines GL on a Thin Film Transistor (TFT) array substrate of the display panel PNL through a TAP process, or may be formed directly on the TFT array substrate of the display panel PNL through a Gate In Panel (GIP) process. In response to gate control data received directly from the timing controller TCON or through the source drive ICs SIC1 to SICn, the gate drive ICs GIC may sequentially supply a gate pulse in synch with the data voltage to the gate lines GL.

FIG. 14 is a diagram illustrating a timing controller and a CDR circuit of a source drive IC.

Referring to FIG. 14, the timing controller TCON rearranges a clock, received from a host system through an LVDS interface or a TMDS interface, and digital video data RGB of an input image to be suitable for the pixel structure of the display panel PL, and transmits the rearranged clock and digital video data RGB to the source drive ICs SIC1 to SICn. In addition, the timing controller TCON converts a signal, in which an EPI clock is embedded between data packets, into a differential signal pair through a transmission buffer 24, and transmits the differential signal pair to the source drive ICs SIC1 to SICn.

A receive buffer 25 of a source drive IC SIC receives a differential signal pair transmitted from the timing controller TCON along a data line pair. A CDR circuit 26 of the source drive IC recovers an internal clock of a received EPI clock, and a sampling circuit 27 of the source drive IC samples control data and digital video data bits in accordance with the internal clock. In response to an output signal of the random signal generator RD, the SOE delay unit SPL randomly delays the SOE signal recovered by the sampling circuit 27. In FIG. 14, SOE' indicates an SOE signal delayed by the SOE delay unit SPL.

Figure 15:
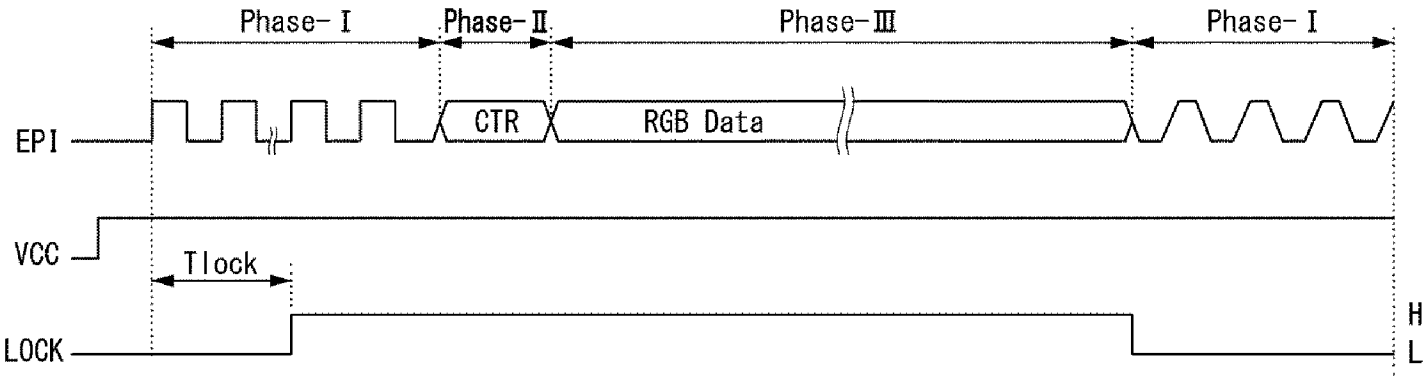
FIG. 15 is a waveform view illustrating an EPI protocol for signal transmission between the timing controller and the source drive ICs, which are shown in FIG. 13.

FIG. 15 is a waveform view illustrating an EPI protocol for transmission of a signal between a timing controller and source drive ICs.

Referring to FIG. 15, in the first phase (Phase-I), the timing controller TCON transmits a clock training pattern signal (or a preamble signal) with constant frequency to the source drive ICs SIC1 to SICn. In response to a lock signal LOCK at a high logic level (or 1) received through a lock feedback line, the timing controller TCON initiates the second phase (Phase-II) to start to transmit control data. In the second phase (Phase-II), the timing controller TCON transmits control data packets (CTR) to the source drive ICs SIC1 to SICn. If the lock signal LOCK is maintained at the high logic level, the timing controller TCON initiates the third phase (Phase-III) to start to transmit data packets (RGB Data) of an input image. In FIG. 15, "Tlock" indicates a period of time starting when a clock training pattern signal starts to be received at the source drive ICs SIC1 to SICn and ending when a lock signal is reversed to the high logic level (H) as outputs from the CDR of the source drive ICs SIC1 to SICn become stabilized. The time Tlock is equal to or longer than one horizontal period.

When a lock signal LOCK at a low logic level (L) is received from the last source drive IC SICn, the timing controller TCON initiates the first phase (Phase-I) to transmit a clock training pattern signal to the source drive ICs SIC1 to SICn in order to resume clock training of the source drive ICs SIC1 to SICn.

Figure 16:
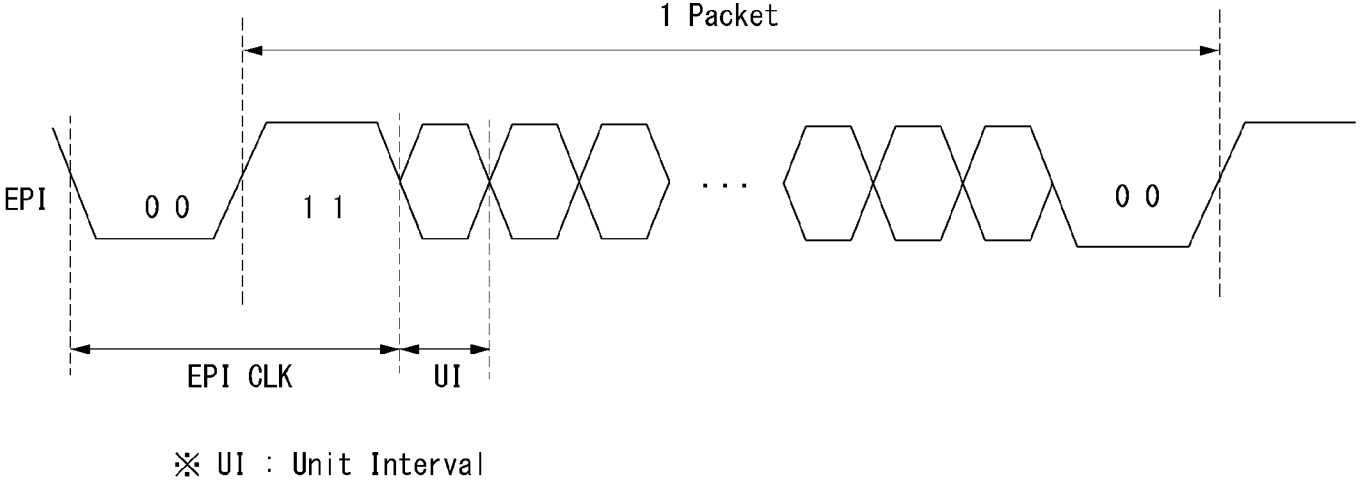
FIG. 16 is a diagram illustrating an example of one data packet length in the EPI protocol.

FIG. 16 is a diagram illustrating one data packet in the EPI protocol.

Referring to FIG. 16, one data packet transmitted from the EPI protocol to the source drive ICs SIC1 to SICn includes a plurality of data bits, and clock bits allocated to a position before and after the data bits. The data bits are bits of control data, or bits of digital video data of an input image. Time required to transmit one bit is referred to as 1 UI (unit interval), and it may differ according to resolution of the display panel PNL or the number of data bits.

The clock bits are allocated for 4 UI between data bits of neighboring packets, and "0 0 1 1 (or L L H H)" may be allocated as a logic value. When the number of data bits is ten (10 bits), one packet may include RGB data bits of 30 UI and clock bits of 4 UI. When the number of data bits is eight (8 bits), one packet may include RGB data bits of 24 UI and clock bits of 4 UI. When the number of data bits is six (6 bits), one packet may include RGB data bits of 18 UI and clock bits of 4 UI. However, aspects of the present disclosure are not limited thereto.

Figure 17:
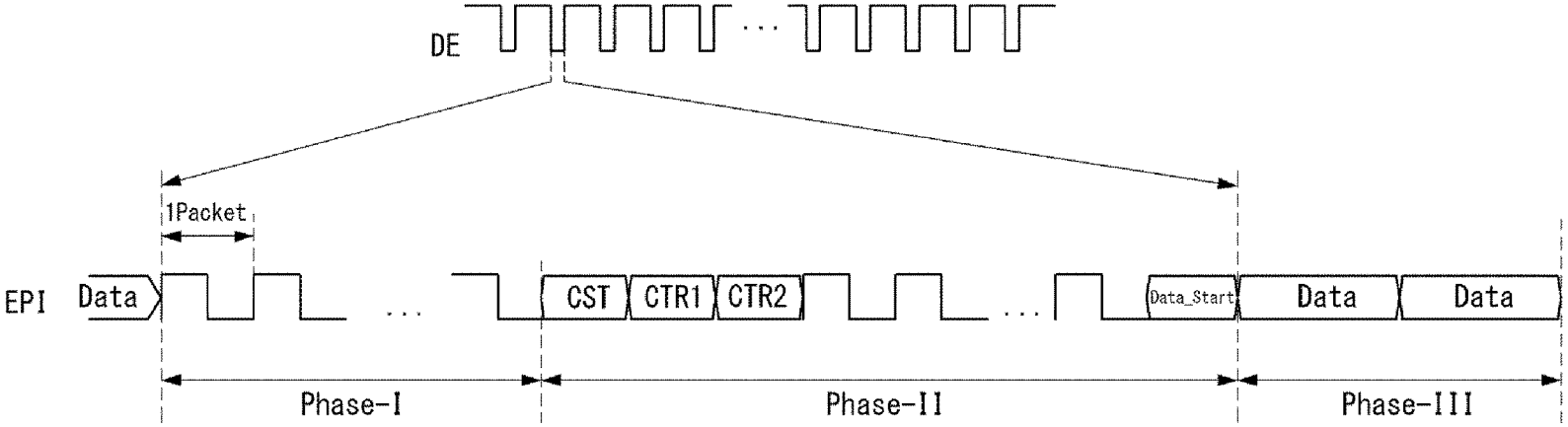
FIG. 17 is a waveform view illustrating EPI signals transmitted in a horizontal blank period (HB)

In the EPI protocol, a first phase (Phase-I) signal, a second phase (Phase-II) signal, and a third phase (Phase-III) signal are transmitted to source drive ICs SIC1 to SICn in every horizontal blank period (HB), as illustrated in FIG. 17. In FIG. 17, "DE" indicates a data enable signal transmitted from a host system to the timing controller TCON, and a pulse of "DE" has a cycle of one horizontal period.

The present disclosure may use a random signal generator to randomly disperse timing of SOE signals temporally and spatially in a source drive IC and between source drive ICs, thereby minimizing the peak current. Furthermore, the present disclosure may use a random signal generator within a timing controller to randomly adjust delay time of SOE signals respectively supplied to the source drive ICs, so that the peak current between the source drive ICs may be further disperse temporally and spatially and therefore it may further improve the effect of EMI reduction.

It will be apparent to those skilled in the art that various modifications and variations can be made in embodiments in accordance with the present disclosure without departing from the spirit or scope of the disclosure. Thus, it is intended that the present disclosure cover the modifications and variations provided they come within the scope of the appended claims and their equivalents.

What is claimed is:

1. A display device, comprising:

a display panel in which data lines and gate lines are intersecting each other and pixels are arranged in a matrix;

a first source drive integrated circuit (IC) and a second source drive integrated circuit (IC) configured to supply a data voltage to the data lines of the display panel in response to a Source Output Enable (SOE) signal; and a timing controller configured to transmit data of an input image and the SOE signal to the first source drive IC, and the second source drive IC, wherein each of the first source drive IC and the second source drive IC comprises:

a first random signal generator configured to generate a first random signal;

a delay unit configured to randomly delay the SOE signal in response to the first random signal to generate a first internal SOE signal and a second internal SOE signal;

a first output group configured to output the data voltage at a first timing in response to the first internal SOE signal; and a second output group configured to output the data voltage at a second timing in response to the second internal SOE signal, wherein output timings of the first internal SOE signal and the second internal SOE signal change frame to frame.

2. The display device of claim 1, wherein the timing controller comprises:

a second random signal generator configured to generate a second random signal; and a signal generator configured to, in response to the second random signal, randomly delay a reference source output signal to generate a first SOE signal for controlling an output timing of the first source drive IC and a second SOE signal for controlling an output timing of the second source drive IC.

3. The display device of claim 2, wherein at least one of the first and second random signal generators comprises a Linear Feedback Shift Register (LFSR).

4. The display device of claim 3, wherein at least one of the delay unit and the signal generator comprises:

a multiplexer configured to, in response to an output signal of the LFSR, select any one of clocks whose phases are sequentially delayed; and a flipflop configured to, in response to a clock received from the multiplexer, output latched input data to output the first and second internal SOE signals.

5. The display device of claim 4, further comprising a switch array disposed between the first random signal generator and the multiplexer, wherein the switch array periodically or randomly changes a signal transmission path between the first random signal generator and the multiplexer.

6. The display device of claim 4, further comprising a switch array disposed between the second random signal generator and the multiplexer, wherein the switch array periodically or randomly changes a signal transmission path between the second random signal generator and the multiplexer.

7. A source drive Integrated Circuit (IC), comprising:

a random signal generator configured to generate a random signal;

a delay unit configured to randomly delay a Source Output Enable (SOE) signal in response to the random signal to generate a first internal SOE signal and a second internal SOE signal;

a first output group configured to output a first data voltage at a first timing in response to the first internal SOE signal; and a second output group configured to output a second data voltage at a second timing in response to the second internal SOE signal, wherein output timings of the first internal SOE signal and the second internal SOE signal change frame to frame.

8. The source drive IC of claim 7, wherein the random signal generator comprises a Linear Feedback Shift Register (LFSR).

9. The source drive IC of claim 8, wherein the delay unit comprises:

a multiplexer configured to, in response to an output signal of the LFSR, select any one of clocks whose phases are sequentially delayed; and a flipflop configured to, in response to a clock received from the multiplexer, output latched input data to output the SOE signals.

10. The source drive IC of claim 9, further comprising a switch array disposed between the random signal generator and the multiplexer, wherein the switch array periodically or randomly changes a signal transmission path between the random signal generator and the multiplexer.

11. A timing controller of a display device, comprising:

a random signal generator configured to generate a random signal; and a signal generator configured to, in response to the random signal, randomly delay a reference source output signal to generate a first Source Output Enable (SOE) signal for controlling an output timing of a first source drive integrated circuit (IC) and a second SOE signal for controlling an output timing of a second source drive IC, wherein output timings of the first SOE signal and the second SOE signal change frame to frame.

12. The timing controller of claim 11, wherein the random signal generator comprises a Linear Feedback Shift Register (LFSR).

13. The timing controller of claim 12, wherein the signal generator comprises:

a multiplexer configured to, in response to an output signal of the LFSR, select any one of clocks whose phases are sequentially delayed; and a flipflop configured to, in response to a clock received from the multiplexer, output latched input data to output the first and second SOE signals.

14. The timing controller of claim 13, further comprising a switch array disposed between the random signal generator and the multiplexer, wherein the switch array periodically or randomly changes a signal transmission path between the random signal generator and the multiplexer.

15. A driving method of a display device, comprising:

generating a first random signal;

in response to the first random signal, randomly delaying a Source Output Enable (SOE) signal to generate a first internal SOE signal and a second internal SOE signal; and controlling an output timing of a first output group within a first source drive Integrated Circuit (IC) in response to the first internal SOE signal, and controlling an output timing of a second output group within the first source drive IC in response to the second internal SOE signal, wherein output timings of the first internal SOE signal and the second internal SOE signal change frame to frame.

16. The driving method of claim 15, further comprising:

generating a second random signal; and in response to the second random signal, randomly delaying a reference source output signal to generating a first SOE signal for controlling an output timing of the first source drive IC and a second SOE signal for controlling a second source drive IC.

* * * * *